US012729930B2

(12) United States Patent
Miller et al.

(10) Patent No.: US 12,729,930 B2
(45) Date of Patent: Sep. 8, 2026

(54) HANDGUARD WITH BARREL NUT LOCKING MECHANISMS

(71) Applicant: Killer Innovations, Inc., Tumwater, WA (US)

(72) Inventors: Michael Allyn Miller, Tenino, WA (US); Richard Olsen, Rainier, WA (US)

(73) Assignee: Killer Innovations, Inc., Tumwater, WA (US)

( * ) Notice: Subject to any disclaimer, the term of this patent is extended or adjusted under 35 U.S.C. 154(b) by 286 days.

(21) Appl. No.: 18/048,623

(22) Filed: Oct. 21, 2022

(65) Prior Publication Data

US 2023/0129047 A1 Apr. 27, 2023

Related U.S. Application Data

(60) Provisional application No. 63/270,305, filed on Oct. 21, 2021.

(51) Int. Cl.
*F41C 23/16* (2006.01)
*F41A 21/48* (2006.01)

(52) U.S. Cl.
CPC ..... *F41C 23/16* (2013.01); *F41A 21/485* (2013.01)

(58) Field of Classification Search
CPC ..... F41C 23/16; F41A 21/485
See application file for complete search history.

(56) References Cited

U.S. PATENT DOCUMENTS 8,562,243 B2 * 10/2013 Dizdarevic ..... F16D 1/094 403/370
8,739,448 B2 * 6/2014 Kimmel ..... F41C 23/16 42/72
8,806,793 B2 * 8/2014 Daniel ..... F41C 23/16 42/75.01
8,863,426 B1 * 10/2014 Zinsner ..... F41C 23/16 42/75.01
8,904,691 B1 * 12/2014 Kincel ..... F41C 23/16 42/71.01
9,157,697 B2 * 10/2015 Leclair ..... F41C 23/16
9,389,043 B1 * 7/2016 Zhang ..... F41C 23/16
9,464,865 B2 * 10/2016 Shea ..... F41C 23/16
(Continued)

FOREIGN PATENT DOCUMENTS

WO 2013010515 A1 1/2013

*Primary Examiner* — Michelle Clement
(74) *Attorney, Agent, or Firm* — EVERSHEDS SUTHERLAND (US) LLP

(57) ABSTRACT

A handguard system of a firearm includes a barrel nut, a handguard, and an adjustable barrel nut locking mechanism. The barrel nut is configured to secure a barrel to the firearm. The handguard includes a pathway, which extends transversely across the handguard. The pathway is configured to receive the adjustable barrel nut locking mechanism. The adjustable barrel nut locking mechanism includes a first wedge member, a second wedge member, and a biasing member. The biasing member is configured to connect the first wedge member to the second wedge member. The biasing member is further configured to incrementally bias the first wedge member toward the second wedge member when the biasing member is actuated. As a result, the first wedge member and the second wedge member are tightened about the barrel nut within the handguard.

17 Claims, 12 Drawing Sheets

(56) References Cited

U.S. PATENT DOCUMENTS

| | | | | |
|---|---|---|---|---|
| 9,476,672 | B2 * | 10/2016 | Wells | F41G 11/003 |
| 9,476,673 | B2 * | 10/2016 | Miller | F16B 39/04 |
| 9,528,793 | B1 * | 12/2016 | Oglesby | F41C 27/00 |
| 9,557,137 | B2 * | 1/2017 | Dzwill | F41A 21/48 |
| 9,599,430 | B1 * | 3/2017 | Geissele | F41C 23/16 |
| 10,018,445 | B2 * | 7/2018 | Fesas | F41A 13/00 |
| 10,066,897 | B2 * | 9/2018 | Hwang | F41A 21/48 |
| 10,126,095 | B1 * | 11/2018 | Reid | F41A 21/48 |
| 10,145,648 | B1 * | 12/2018 | Holder | F41C 23/16 |
| 10,240,892 | B2 * | 3/2019 | Leitner-Wise | F41C 23/16 |
| 10,309,747 | B2 * | 6/2019 | Samson | F41A 21/48 |
| 10,352,650 | B2 * | 7/2019 | Hiler, Jr. | F41A 21/482 |
| 10,436,549 | B1 * | 10/2019 | Taylor | F41C 23/16 |
| 10,591,247 | B2 * | 3/2020 | Hubbell | F41G 11/003 |
| 10,619,971 | B2 * | 4/2020 | Hubbell | F41C 23/16 |
| 10,670,369 | B1 * | 6/2020 | Ding | F41A 3/66 |
| 10,775,129 | B1 * | 9/2020 | Kincel | F41C 23/16 |
| 10,809,038 | B2 * | 10/2020 | Geissele | F41C 23/16 |
| 10,935,343 | B2 * | 3/2021 | Chin | F41A 11/00 |
| 11,248,874 | B2 * | 2/2022 | Kincel | F41A 21/485 |
| 11,326,853 | B2 * | 5/2022 | Zinsner | F41C 23/16 |
| 11,365,953 | B2 * | 6/2022 | Kincel | F41C 23/16 |
| 11,371,802 | B2 * | 6/2022 | Liao | F41A 21/48 |
| 11,892,260 | B2 | 2/2024 | Markut | |
| 12,203,725 | B2 * | 1/2025 | Boomgaarden | F41C 23/16 |
| 2011/0126443 | A1 * | 6/2011 | Sirois | F41C 27/00 42/90 |
| 2014/0373419 | A1 * | 12/2014 | Leclair | F41C 23/16 42/71.01 |
| 2017/0023329 | A1 * | 1/2017 | Gottzmann | F41C 23/16 |
| 2018/0202757 | A1 * | 7/2018 | Samson | F41A 21/48 |
| 2018/0306551 | A1 * | 10/2018 | Reid | F41A 21/485 |
| 2022/0018629 | A1 * | 1/2022 | Senff | F41C 23/18 |
| 2022/0128331 | A1 * | 4/2022 | Kincel | F41C 23/16 |
| 2022/0252374 | A1 * | 8/2022 | Louthan | F41C 23/16 |
| 2022/0260335 | A1 * | 8/2022 | Williams | F41G 11/003 |
| 2022/0282951 | A1 * | 9/2022 | Wiggins | F41C 23/16 |
| 2022/0404119 | A1 * | 12/2022 | Zinsner | F41C 23/16 |
| 2023/0129047 | A1 * | 4/2023 | Miller | F41C 23/16 42/75.01 |
| 2024/0003654 | A1 * | 1/2024 | Boomgaarden | F41C 23/16 |

* cited by examiner

HANDGUARD WITH BARREL NUT LOCKING MECHANISMS

CROSS-REFERENCE TO RELATED PATENT APPLICATION

This application is a non-provisional of and claims the priority benefit of U.S. App. No. 63/270,305 filed Oct. 21, 2021, the entire contents of which are hereby incorporated by reference herein.

TECHNICAL FIELD

The present application relates generally to a handguard of a firearm with barrel nut locking mechanisms.

BACKGROUND

Barrel nut locking mechanisms have been an integral and important part of modern firearms. Barrel nut locking mechanisms help ensure of the handguard is securely attached to the firearm upper via the barrel nut. These barrel nut locking mechanisms prevent movement of the handguard with respect to the firearm upper. However, vibration and other forces can still adversely change the position of the handguard relative to the firearm upper, which can impair the use and function of the firearm, such as impacting accuracy of iron sights when the front sight is attached to the handguard. Thus, there is a need for an improved handguard with barrel nut locking mechanisms.

DETAILED DESCRIPTION

Figure 1:
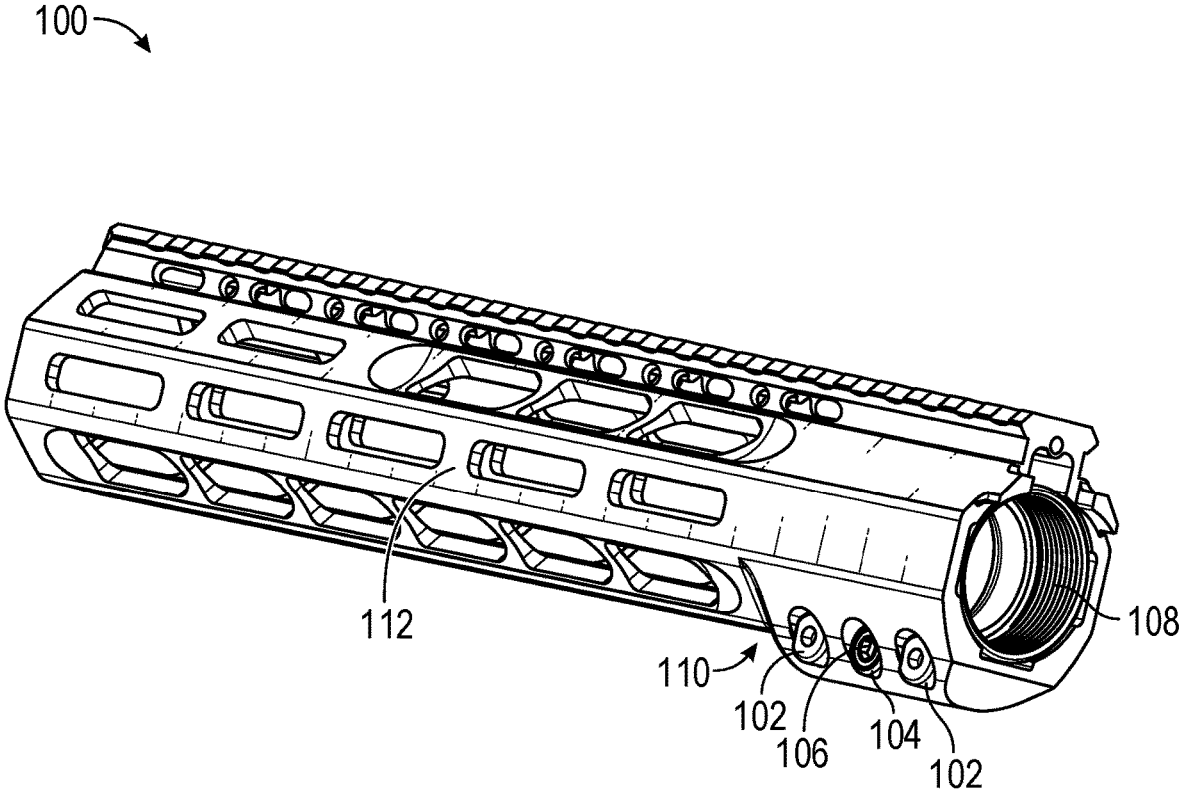
FIG. 1 is a perspective view of a handguard with barrel nut locking mechanisms according to one or more examples of the disclosure.

The present disclosure provides for a handguard system 100 of a firearm. The handguard system 100 may include a barrel nut 108, a handguard 112, and one or more adjustable barrel nut locking mechanisms 110. The barrel nut 108 may be configured to secure a barrel to the firearm. The handguard 112 may include one or more pathways 290, which may extend transversely across the handguard 112. A pathway 290 may be configured to receive an adjustable barrel nut locking mechanism 110. An adjustable barrel nut locking mechanism 110 may include a first wedge member 102, a second wedge member 104, and a biasing member 106. The biasing member 106 may be configured to connect a first wedge member 102 to a second wedge member 104. The biasing member 106 may further be configured to incrementally bias the first wedge member 102 and the second wedge member 104 towards one another when the biasing member 106 is actuated. As a result, the first wedge member 102 and the second wedge member 104 may be tightened about the barrel nut 108 within the handguard 112.

By way of example, the handguard system 100 may include one or more adjustable barrel nut locking mechanisms 110. In an embodiment, the first wedge member 102 may include a tapped wedge 102A, the second wedge member 104 may include a bore nut 104A, and the biasing member 106 may include a screw 106A. The tapped wedge 102A may have a tapped hole 124A corresponding to a thread pattern 106B of the screw 106A such that the tapped wedge 102A and the bore nut 104A of each adjustable barrel nut locking mechanism 110 may be connected by the screw 106A. The screw 106A may be tightened to draw the tapped wedge 102A and the bore nut 104A toward one another in a pathway 290 within the handguard 112, which may cause the tapped wedge 102A and the bore nut 104A to tighten about the barrel nut 108, such as by a pinching, binding, or compressing motion. One or more embodiments of the handguard system 100 are disclosed in the attached sheets and figures.

As shown in FIG. 1, in some embodiments, the handguard 112 may be any shape or configuration as desired for operating as a handguard. The handguard 112 may be attached to the barrel nut 108, which is a commonly used device for securing a barrel to an upper receiver of a firearm. The handguard 112 may be securely attached to the barrel nut 108 by one or more adjustable barrel nut locking mechanisms 110.

Figure 2:
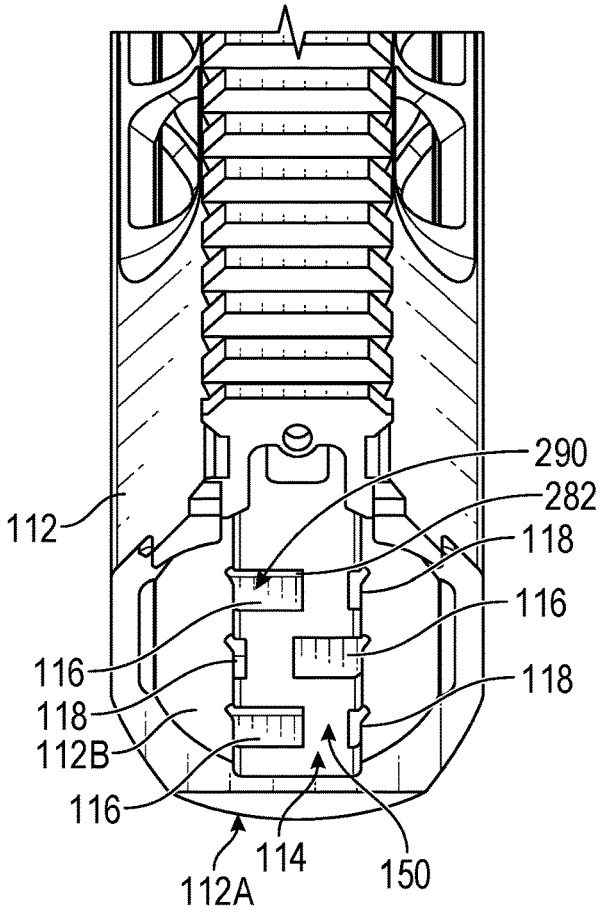
FIGS. 2-4 are perspective views of a handguard with barrel nut locking mechanisms according to one or more examples of the disclosure.
Figure 3:
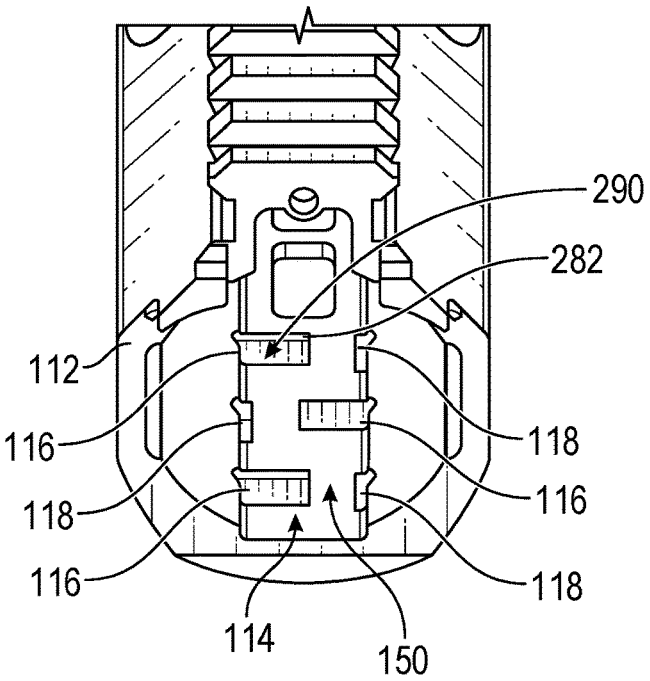
Figure 4:
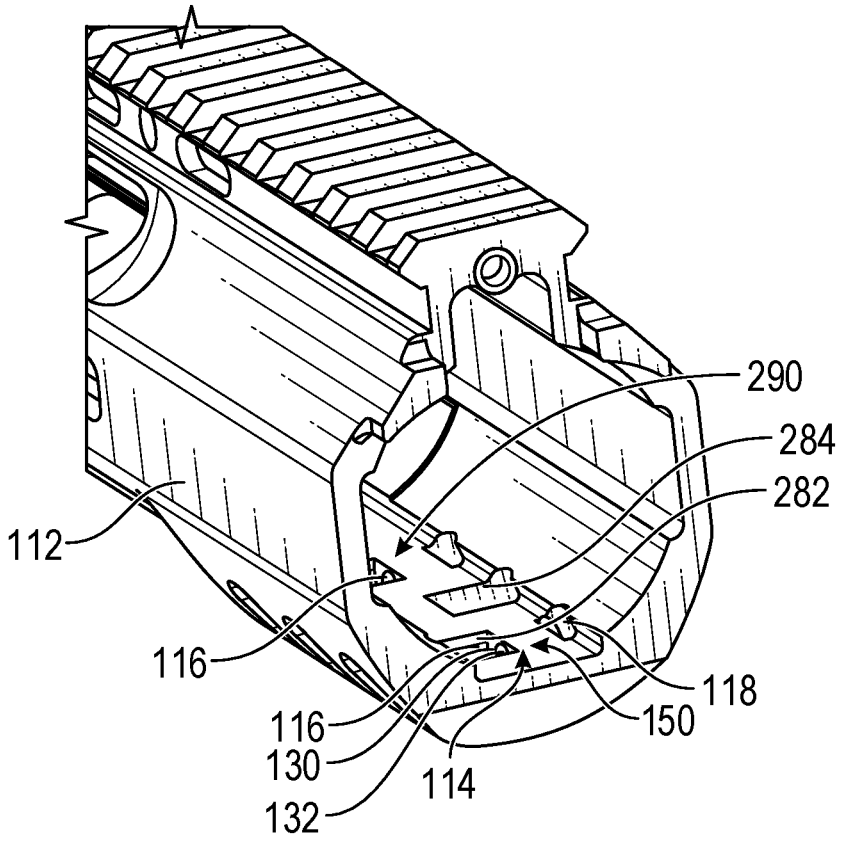
Figure 5:
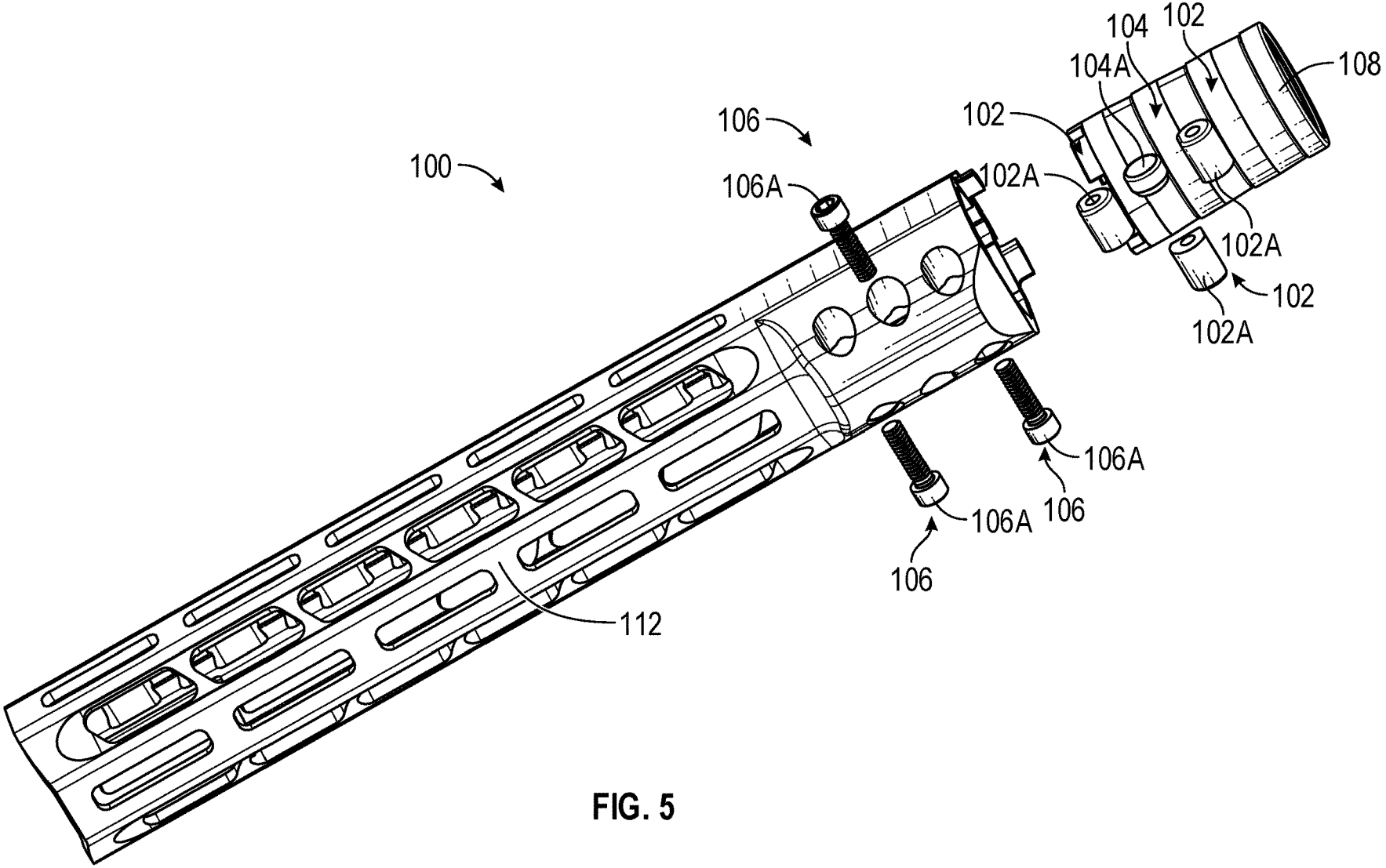
FIG. 5 is an exploded view of a handguard with barrel nut locking mechanisms according to one or more examples of the disclosure.

As shown in FIGS. 2-4, in some embodiments, the handguard 112 may further include a channel 114, which may extend longitudinally along the handguard 112. The channel 114 may be defined by the handguard 112. The geometry of the channel 114 may correspond to the geometry of the barrel nut 108 such that the barrel nut 108 may fit within the channel 114, either in whole or in part. In certain embodiments, each pathway 290 may intersect with the channel 114 such that the pathway 290 and the channel 114 are in communication with one another. In some embodiments, the first wedge member 102 and the second wedge member 104 may be configured to tighten about the barrel nut 108 in combination with the inside surface of the handguard 112 defining the channel 114 upon actuation of the biasing member 106.

Referring now to FIG. 2, a rear view of the handguard 112 without any adjustable barrel nut locking mechanism 110 is shown. In some embodiments, the channel 114 may be disposed within the handguard 112 at a proximate end 112A of the handguard 112. In other embodiments, the channel 114 may extend or be located a greater or lesser relative distance from the proximate end 112A of handguard 112. In some embodiments, the handguard 112 may have one or more pathways 290 extending transversely through the handguard 112. The handguard 112 may have any number of pathways 290, which may each be similarly or differently configured to one another depending on the specific application of the handguard system 100. Each pathway 290 may extend through the handguard 112 adjacent to the channel 114, and portions of each pathway 290 may be in communication with the channel 114. For example, a pathway 290 may intersect channel 114 at a preferred location to enable tightening of the barrel nut 108 against the inner surface 112B of handguard 112 when an adjustable barrel nut locking mechanism 110 is inserted within the pathway 290 and the barrel nut 108 is placed against the channel 114.

Referring now to FIG. 3, a closer perspective view of the aspects of the present invention described with respect to FIG. 2 is shown.

Referring now to FIG. 4, in some embodiments, each pathway 290 may include a first section 116, a second section 118, and a middle section 130. The first section 116 may be geometrically configured to receive the first wedge member 102, the second section 118 may be geometrically configured to receive the second wedge member 104, and the middle section 130 may be geometrically configured to separate the first section 116 and the second section 118 such that the biasing member 106 may pass through the middle section 130 in order to connect the first wedge member 102 to the second wedge member 104. For example, with respect to embodiments wherein the first wedge member 102 includes a tapped wedge 102A, the second wedge member 104 includes a bore nut 104A, and the biasing member 106 includes a screw 106A, the first section 116 may include a tapped wedge cutout 116A corresponding to the geometry of the tapped wedge 102A, the second section 118 may include a bore nut cutout 118A corresponding to the geometry of the bore nut 104A, and the middle section 130 may include a hollow passage 132 configured to accommodate travel of the screw 106A in connection with the tapped wedge 102A and/or the bore nut 104A.

As shown in FIGS. 12A-12C, 13, and 14, in some embodiments, the first section 116 of the pathway 290 may be configured with a cutout profile corresponding to an asymmetrical outer profile of the first wedge member 102 such that the first wedge member 102 may only be received by the first section 116 at a preferred orientation with respect to the longitudinal axis of the handguard 112. For example, in embodiments where the first wedge member 102 includes a tapped wedge 102A and the first section 116 includes a tapped wedge cutout 116A, the tapped wedge cutout 116A may be configured such that the tapped wedge 102A may only be inserted into the tapped wedge cutout 116A at a direction that facilitates tightening of the tapped wedge 102A against the barrel nut 108 within the handguard 112. Moreover, the tapped wedge cutout 116A may be configured such that the tapped wedge 102A may not be inserted at an orientation that would damage the barrel nut 108 or the handguard 112 if tightening were to occur.

Figure 13:
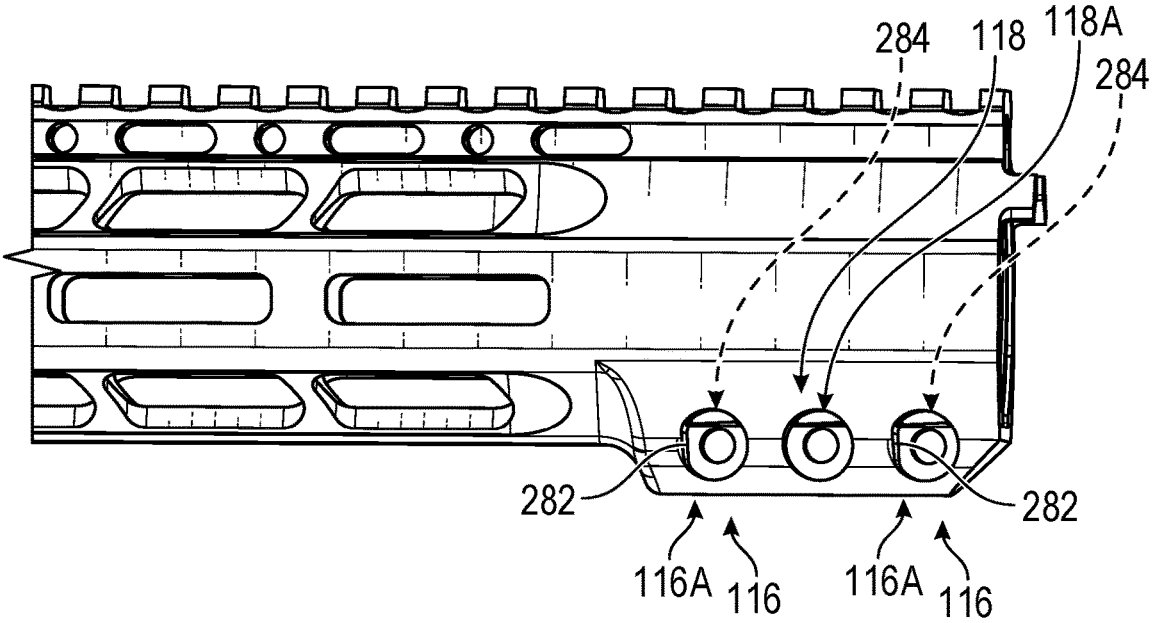
FIG. 13 is a side view of a handguard according to one or more examples of the disclosure.

Referring now to FIG. 13, for example, the first section 116 of each pathway 290 may have a cutout profile including a flat wall 282 opposite a curved wall 284, which may correspond to an asymmetrical outer profile of the first wedge member 102. In other embodiments, the first section 116 may include teeth, keyed extrusions, or other cutouts corresponding to an asymmetrical outer profile of the first wedge member 102 and similarly facilitating preferred orientation of the first wedge member 102 with respect to the handguard 112 while restricting rotation of the first wedge member 102 within the pathway 290. In various embodiments, the geometry of the first wedge member 102 may prevent the first wedge member 102 from rotating within the pathway 290, either entirely or except within a fixed degree of rotation.

Figure 12A:
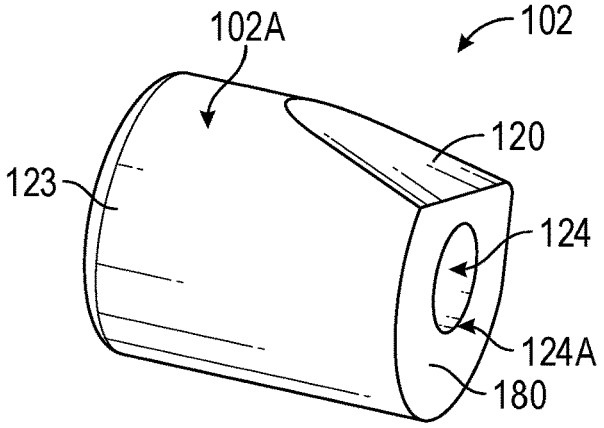
FIGS. 12A, 12B, and 12C are views of a tapped wedge according to one or more examples of the disclosure.
Figure 12B:
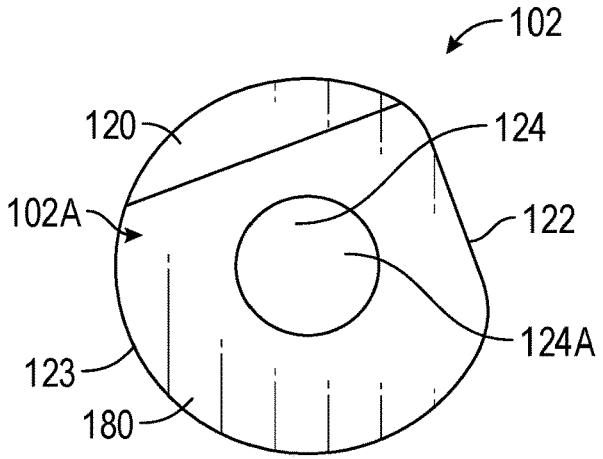
Figure 12C:
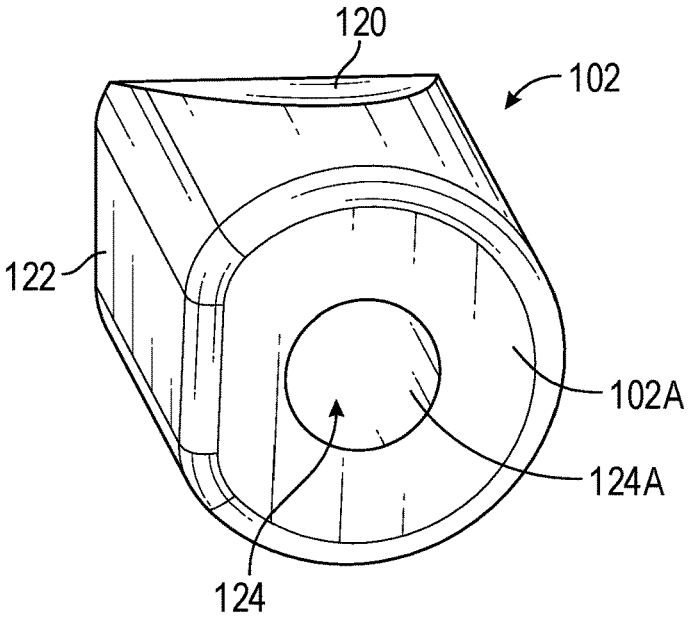

Referring now to FIGS. 12A-12C, in some embodiments, the first wedge member 102 may include at least one flat wedge surface 122 and at least one curved wedge surface 123 in an asymmetrical configuration. In other embodiments, the first wedge member 102 may have any number of configurations to facilitate preferred orientation within the handguard system 100.

Figure 14:
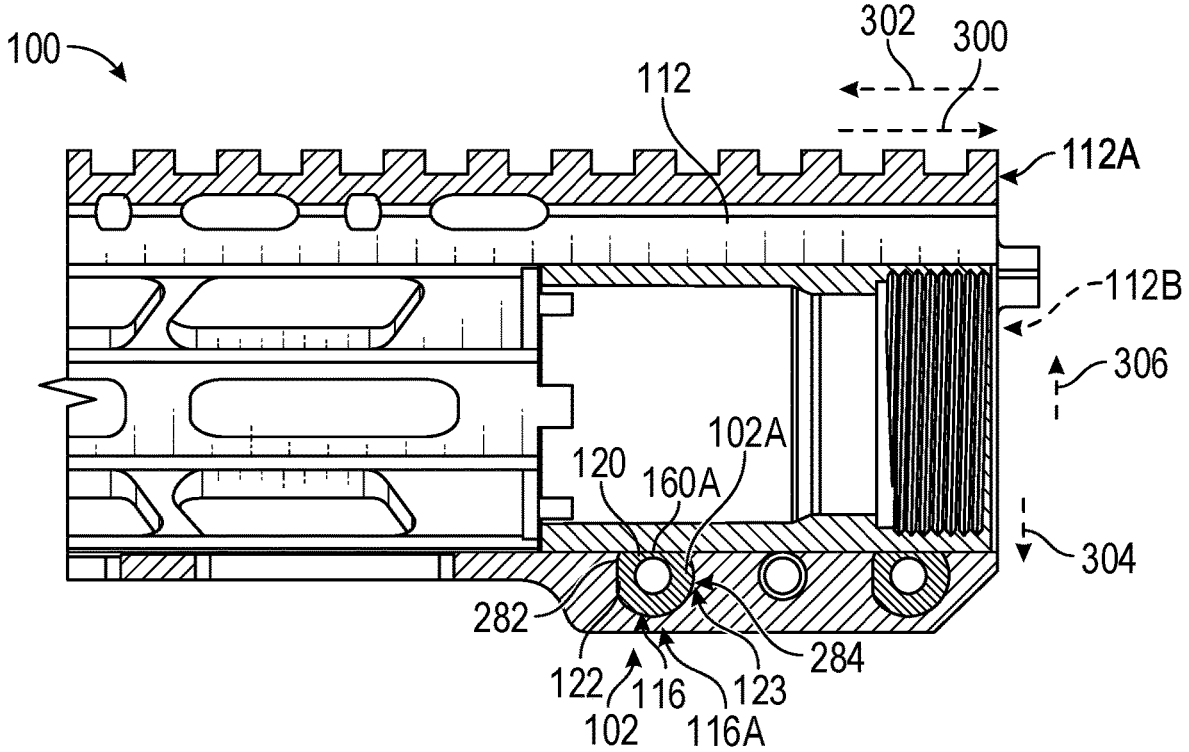
FIGS. 14-15 are other views according to one or more examples of the disclosure.
Figure 15:
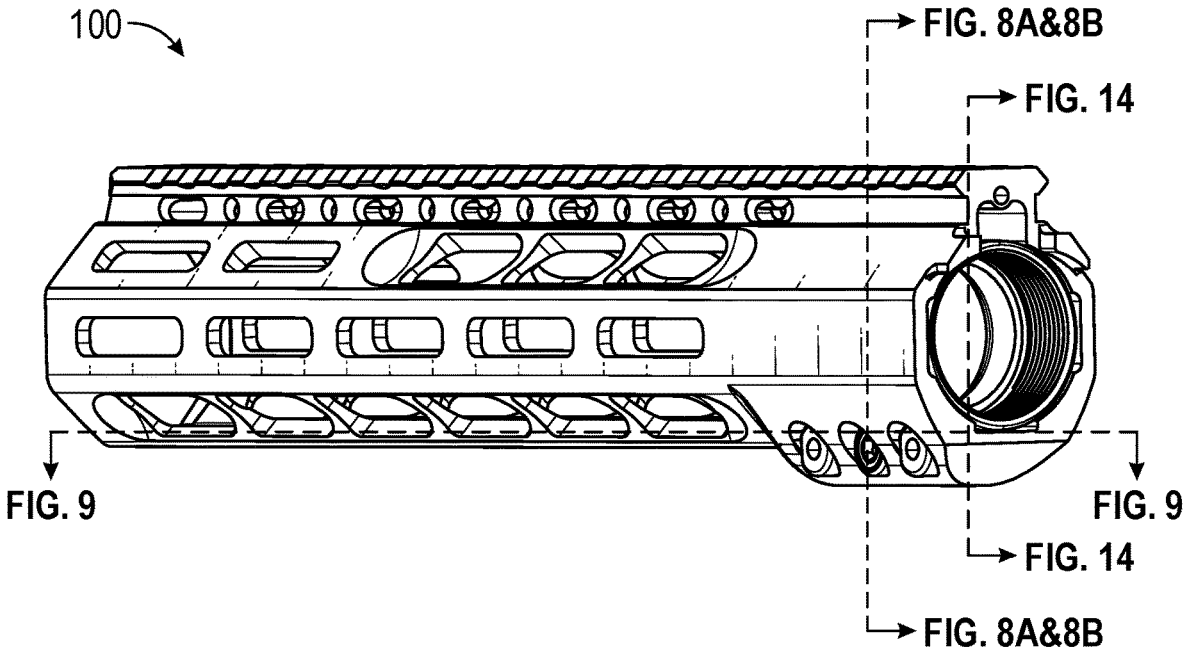

Referring now to FIG. 14, in some embodiments, the first wedge member 102 may only fit into the first section 116 with the preferred orientation. For example, when the first wedge member 102 includes a tapped wedge 102A, as shown in FIG. 14, the tapped wedge 102A may have a flat wedge surface 122 and a curved wedge surface 123 in an asymmetrical configuration. The flat wedge surface 122 may correspond to the flat wall 282 of the first section 116 of the pathway 290, while the curved wedge surface 123 may correspond to the curved wall 284 of the pathway 290. Accordingly, the tapped wedge 102A may only be inserted into the first section 116 at a preferred orientation, that is, with the tapped wedge 102A facing the longitudinal axis of the handguard 112.

As shown in FIGS. 7, 8A-8B, 11A-11B, and 12A-12C, the first wedge member 102, the second wedge member 104, and the biasing member 106 may fit into the pathway 290 within or adjacent to the handguard 112. In certain embodiments, the first wedge member 102 and the second wedge member 104 may further be configured to engage with the barrel nut 108 at a direction, for example, substantially normal to the barrel nut 108.

Figure 8B:
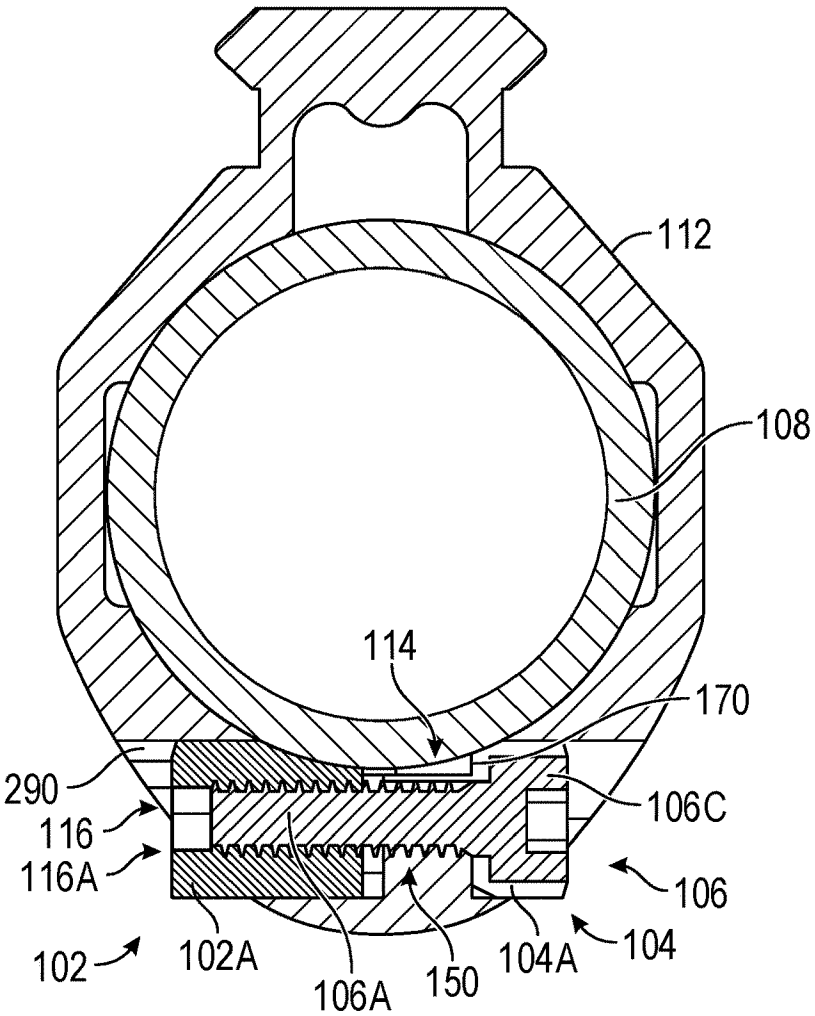
FIGS. 8A and 8B are vertical cross-sections of a handguard with barrel nut locking mechanisms according to one or more examples of the disclosure.
Figure 8A:
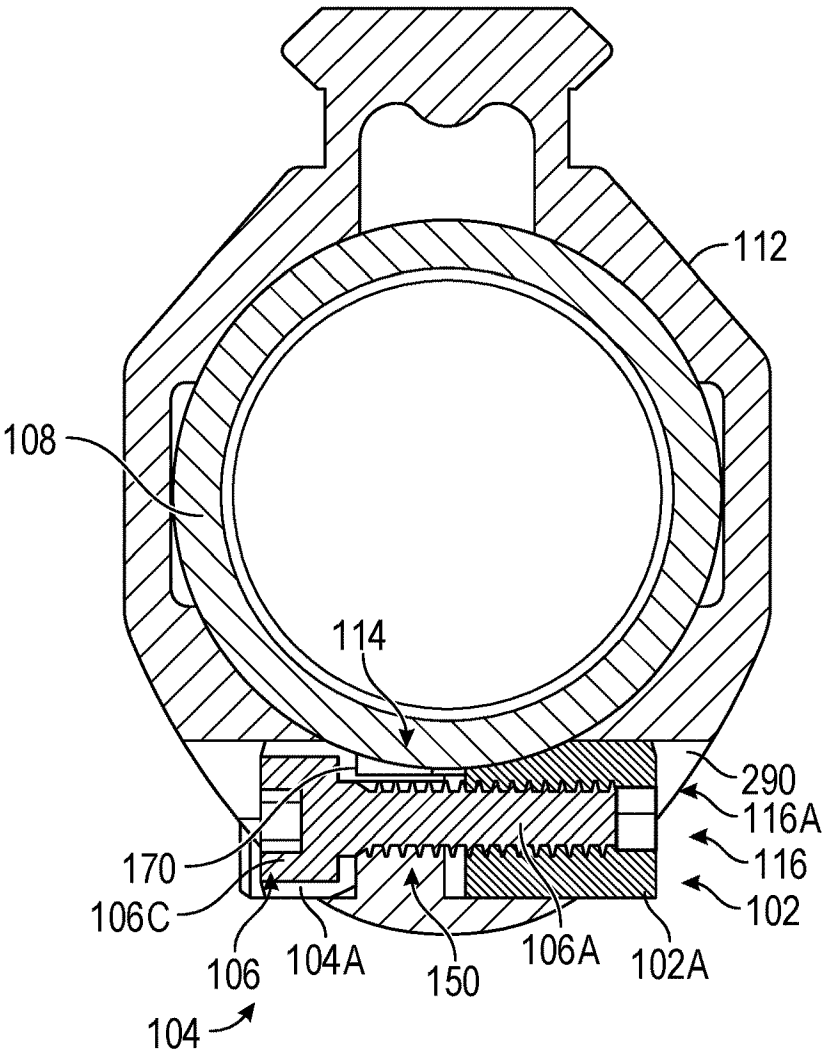

Referring now to FIGS. 8A-8B, in some embodiments, first wedge member 102 may include, for example, a tapped wedge 102A that extends through first section 116 to secure the barrel nut 108 by, for example, pinching or compressing the barrel nut 108 against a first wedge adjustment surface 120 and a second inward end 170 of the second wedge member 104, which may include, for example, a bore nut 104A. In other embodiments, the first wedge member 102 and/or the second wedge member 104 may include a number of other components with different surface configurations to facilitate tightening of the barrel nut 108 within the handguard 112.

Referring further to FIGS. 2-4, 8A-8B, 9, 11A-11B, 12A-12C, in various embodiments, features of the adjustable barrel nut locking mechanism 110 may further facilitate securement of the barrel nut 108. For example, the first wedge member 102 may include a first hole 124. In embodiments where, for example, the biasing member 106 includes a screw 106A, the first hole 124 may be tapped so as to correspond with the thread pattern 106B of the screw 106A and dimensioned such that the screw 106A may be inserted through the first hole 124. Moreover, the second wedge member 104 may include a corresponding second hole 126, which may not be threaded. The second hole 126 may be configured to accept the biasing member 106 such that the biasing member 106 may be actuated in communication with the second wedge member 104. For example, in embodiments where the biasing member 106 includes a screw 106A and the second wedge member 104 includes a bore nut 104A, the second hole 126 may be configured to accept the screw 106A such that a head 106C of the screw 106A may be turned within the bore nut 104A. Accordingly, the first wedge member 102 (e.g., the tapped wedge 102A) may be connected to the second wedge member 104 (e.g., the bore nut 104A) by the biasing member 106 (e.g., the screw 106A) via insertion through the second hole 126 and into the first hole 124. The first hole 124 may be adjacent to the first inward end 180, which may be inserted into the pathway 290. Further, the first wedge member 102 may include a first wedge adjustment surface 120 and a flat wedge surface 122. The first wedge adjustment surface 120 may be angled relative to the longitudinal axis of the first wedge member 102 for abutment against the barrel nut 108 and may extend through the first section 116 of the pathway 290 for engagement with the barrel nut 108 to secure the handguard 112 thereto.

The flat wedge surface 122 may be parallel with the longitudinal axis of the first wedge member 102 and configured to engage with the flat wall 282 of the first section 116 of the pathway 290 to ensure the first wedge member 102 is inserted with the first wedge adjustment surface 120 facing a preferred direction, for example, toward the central axis of the handguard 112 and/or the second section 118 of the pathway 290. The first wedge member 102 may be configured to be pulled toward the barrel nut 108 by tightening the biasing member 106. The first wedge member 102 may be pulled up to the point where the first inward end 180 contacts the divider 150, as described further with respect to FIG. 9 below.

The first wedge adjustment surface 120 may be configured to, for example, wedge securely toward the second wedge member 104, effectively pinching or binding barrel nut 108 within the handguard 112. While three combinations of first wedge members 102 and second wedge members 104, in alternating orientations, are embodied herein as adjustable barrel nut locking mechanisms 110A, 110B, 110C, there may be fewer or more combinations based on the needs of a particular application. For example, and as described further with respect to FIGS. 6 and 9 below, in another embodiment, a single adjustable barrel nut locking mechanism 110 may be used. In still another embodiment, two adjustable barrel nut locking mechanisms 110 may be used.

In various embodiments, the first wedge member 102 and the barrel nut 108 may be drawn together by tightening the biasing member 106, thereby pinching or binding the barrel nut 108 between the first wedge adjustment surface 120 of the first wedge member 102 and the second inward end 170 of the second wedge member 104. The first wedge adjustment surface 120 may be free to move longitudinally in the pathway 290 until abutting the barrel nut 108. In engaging the flat wall 282, the flat wedge surface 122 may ensure that the first wedge adjustment surface 120 axially aligns with the barrel nut 108. As the first wedge adjustment surface 120 presses the barrel nut 108 against a second wedge adjustment surface 176 of the second wedge member 104, the barrel nut 108 may become separated from the bottom 304 of the handguard 112 and raised in the channel 114 until the barrel nut 108 is forced against the top 306 of the inner surface 112B of the handguard 112, forcing the handguard 112 to collinearly align with the barrel nut 108. The first wedge adjustment surface 120 may also be configured to adjust the barrel nut 108 in a forward direction 300, along the direction of insertion of the barrel nut 108 into the handguard 112, as described further with respect to FIGS. 10A-10B and 14 below.

Figure 9:
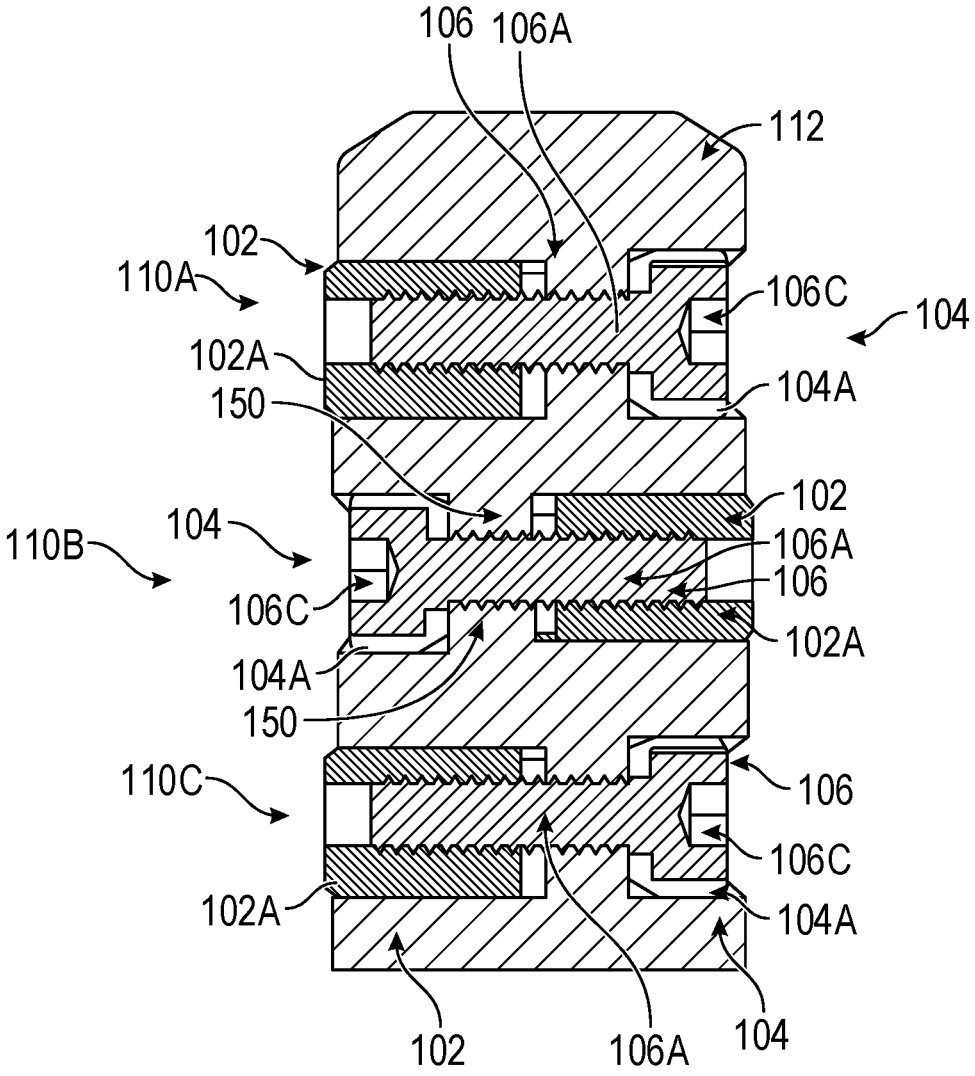
FIG. 9 is a horizontal cross-section of a handguard with barrel nut locking mechanisms according to one or more examples of the disclosure

In further embodiments, the second wedge member 104 may be configured such that the biasing member 106 passes through the second hole 126. The second wedge member 104 may be positioned within the second section 118 of the pathway 290. The second wedge member 104 may act as a fixed portion against which the barrel nut 108 is compressed when the first wedge member 102 is tightened by the biasing member 106. As shown, for example, in FIGS. 8A, 8B, 11A, and 11B, the second wedge member 104 may include a second inward end 170, which may fit within the pathway 290 of the handguard 112, in addition to the second wedge adjustment surface 176. The second wedge adjustment surface 176 may be angled relative to the longitudinal axis of the second wedge member 104 for abutment against the barrel nut 108 and may extend through the second section 118 of the pathway 290 for engagement with the barrel nut 108 to secure the handguard 112 thereto. The second inward end 170 may act as a second effective wedge as the first wedge member 102 pushes the barrel nut 108 into the second wedge adjustment surface 176 of the second wedge member 104. In some embodiments, the second wedge member 104 may have a second outward end 172 facing outside of the handguard 172 and a recess 174 adjacent to the second outward end 172. The recess 174 may be configured to receive a portion of the biasing member 106, for example, the head 106C of a screw 106A, as shown in FIGS. 8A, 8B and 9. The second wedge member 104 may have the second inward end 170 rest against the divider 150 in order for the biasing member 106 to be inserted therein, through the pathway 290, and into the first hole 124 of the first wedge member 102. Accordingly, the adjustable barrel nut locking mechanism 110 may have improved precision or securing capabilities.

Figure 10A:
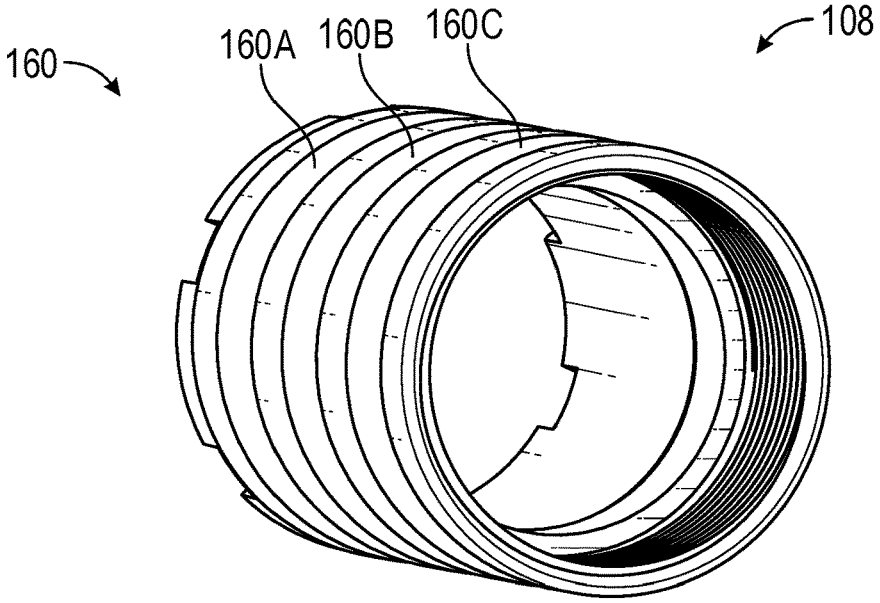
FIGS. 10A and 10B are, respectively, a perspective view and a cross-section view of a barrel nut according to one or more examples of the disclosure.
Figure 10B:
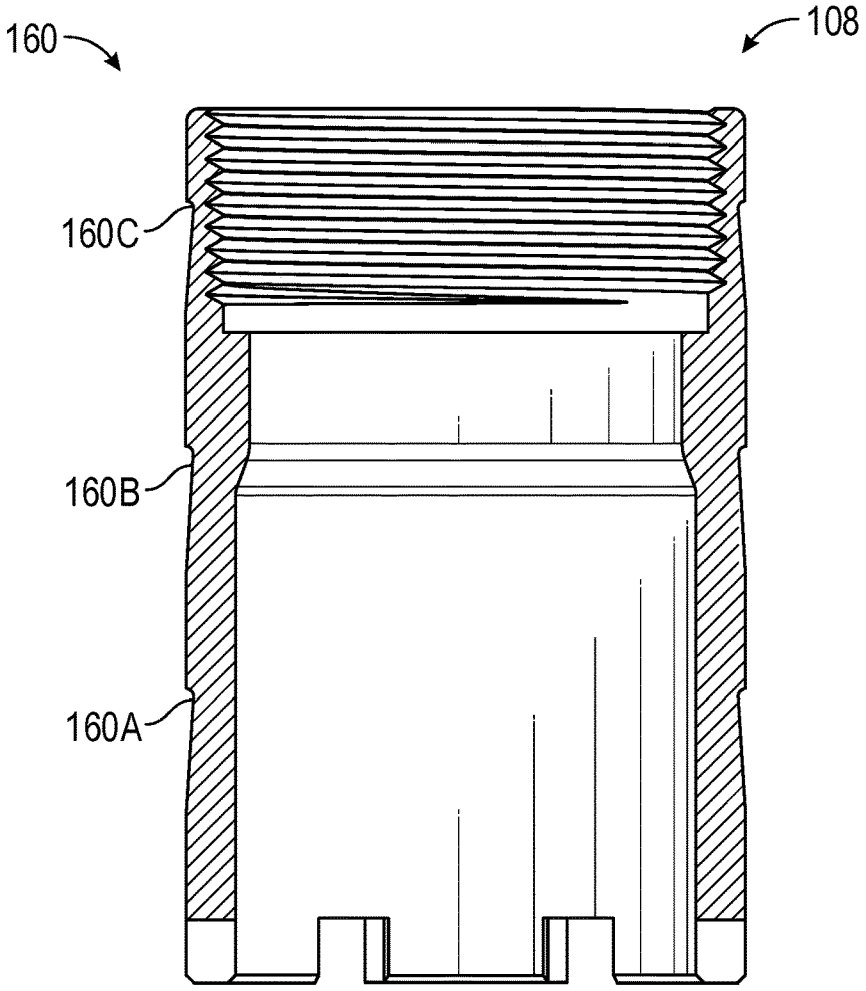
Figure 11A:
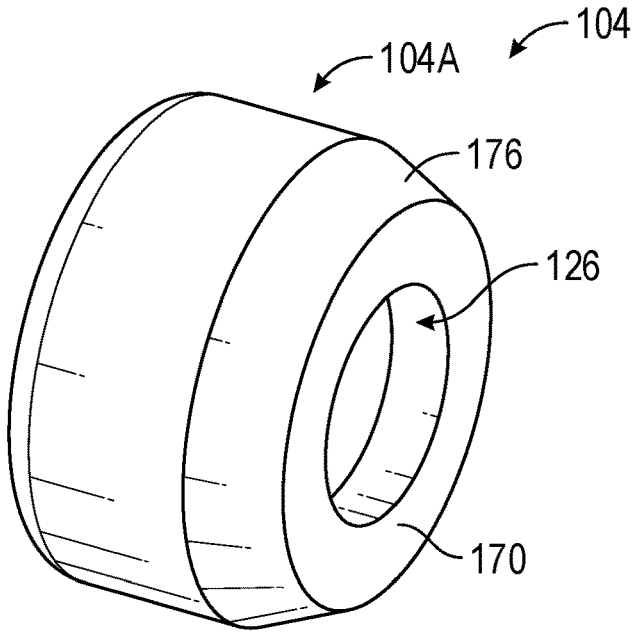
FIGS. 11A and 11B are views of a bore nut according to one or more examples of the disclosure.
Figure 11B:
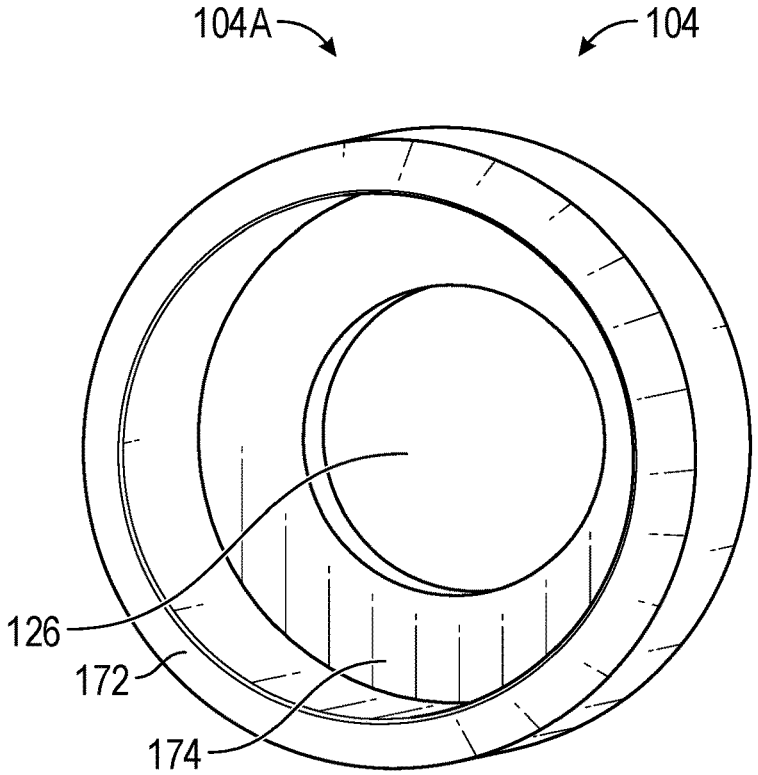

As shown in FIGS. 10A-10B and 14, in some embodiments, the barrel nut 108 may be configured in any suitable shape for a barrel nut. The barrel nut 108 may further be configured with one or more locating features intended to facilitate proper location of the barrel nut 108 with respect to the handguard 112.

Referring now to FIGS. 10A-10B, in some embodiments, the barrel nut 108 may, for example, have a radial profile 160, which may be configured to engage at least one of the first wedge member 102 and the second wedge member 104 of the adjustable barrel nut locking mechanism 110 at a preferred longitudinal position of the barrel nut 108 with respect to the proximate end 112A of the handguard 112. In other embodiments, the radial profile 160 may include one or more features configured to bias the handguard 112 with respect to the barrel nut 108 when the radial profile 160 is engaged by at least one of the first wedge member 102 and the second wedge member 104. For instance, the radial profile 160 may include recessed rings 160A, 160B, 160C located around the outside surface of the barrel nut 108, which may be configured with sloped diameters to receive the first wedge adjustment surface 120 of the first wedge member 102 and/or the second wedge adjustment surface 176 of the second wedge member 104.

Referring now to FIG. 14, in some embodiments, the recessed rings 160A, 160B, 160C of the barrel nut 108 may be angled to drive the handguard 112 toward an upper receiver of a firearm until the top 306 of the inner surface 112B of the handguard 112 contacts the barrel nut 108. The recessed rings 160A, 160B, and 160C may each have a sloped diameter, which may drive the barrel nut 108 in the forward direction 300 toward the upper receiver of the firearm when the adjustable barrel nut locking mechanisms 110 are tightened. This rearward force may limit travel of the handguard 112 in a rearward direction 302 and secure the handguard 112 in a most rearward position. The tightening of the first wedge member 102 toward the second wedge member 104 may compress or pinch the first wedge adjustment surface 120 of the first wedge member 102 and the second wedge adjustment surface 176 of the second wedge member 104 against the barrel nut 108. The first wedge adjustment surface 120 of the first wedge member 102 and the second wedge adjustment surface 176 of the second wedge member 104 may engage with the angled surfaces of the recessed rings 160A, 160B, 160C. When the barrel nut 108 is coupled to an upper receiver of a firearm, the shapes of the first wedge adjustment surface 120, the second wedge adjustment surface 176, and the recessed rings 160A, 160B, 160C may drive the handguard 112 in the forward direction 300 toward the upper receiver.

Figure 6:
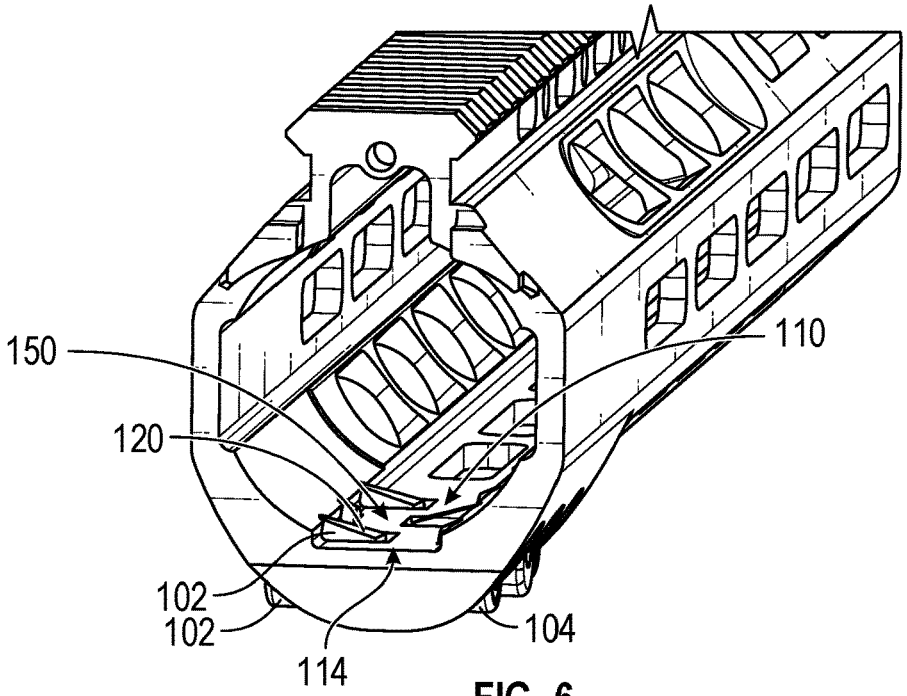
FIG. 6 is a perspective view of a handguard with barrel nut locking mechanisms according to one or more examples of the disclosure.
Figure 7:
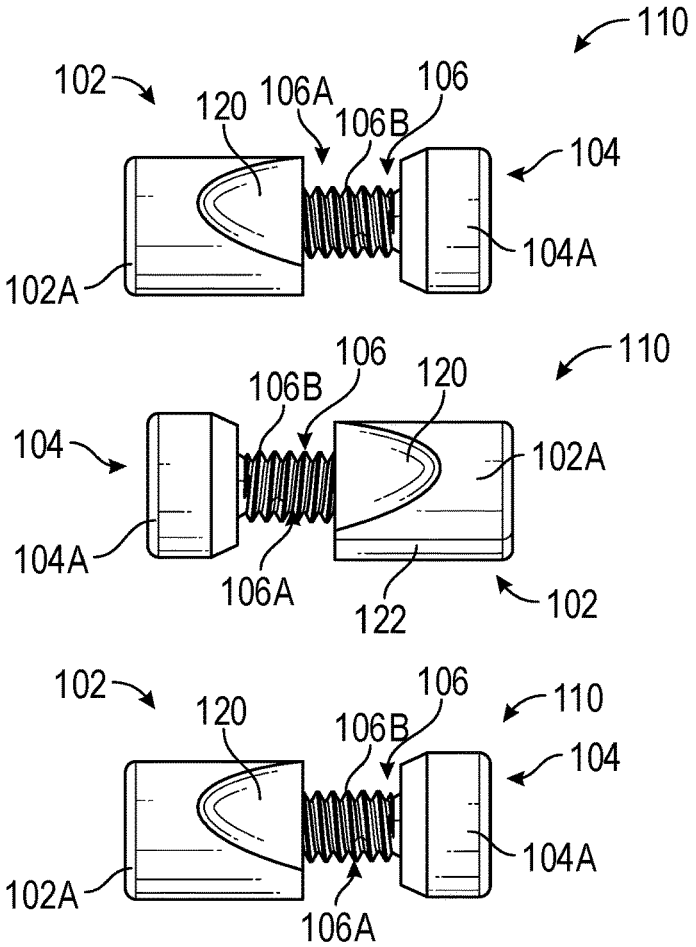
FIG. 7 is a view of various locking mechanisms according to one or more examples of the disclosure.

Referring now to FIGS. 6 and 9, in various embodiments, the handguard system 100 may include any number of pathways 290 corresponding to any number of adjustable barrel nut locking mechanisms 110 in a variety of configurations that may, in effect, provide better stability of the barrel nut 108 when secured within the handguard 112 by the adjustable barrel nut locking mechanisms 110. In certain embodiments, for example, the handguard system 100 may include two transverse pathways 290, within both of which may be inserted one of the adjustable barrel nut locking mechanisms 110. Such pathways 290 may be configured, for instance, in diametrically opposite orientations about a longitudinal axis of the handguard 112. In still other embodiments, the handguard system 100 may include three transverse pathways 290, within each of which may be inserted one of the adjustable barrel nut locking mechanism 110. Such pathways 290 may be configured, for instance, in diametrically alternating orientations about a longitudinal axis of the handguard 112. Further still, in accordance with previously described embodiments including one or more tapped wedges 102A, bore nuts 104A, and screws 106A, the adjustable barrel nut locking mechanisms 110 may involve each screw 106A connecting a tapped wedge 102A to a bore nut 104A. In such embodiments, each adjustable barrel nut locking mechanism 110 may alternate in orientation so that each tapped wedge 102A is located on an opposite side as the preceding tapped wedge 102A. Accordingly, the barrel nut 108 may be secured with greater stability within the handguard 112. Other embodiments involving still further configurations may, of course, be employed for similar purposes.

Referring now to FIG. 9, in some embodiments, the handguard system 100 may include a divider 150, which may be located proximate to the pathway 290 such that the movement of the first wedge member 102 toward the second wedge member 104 may be limited. The divider 150 may be configured to restrict travel of the first wedge member 102 about the pathway 290 and with respect to the second wedge member 104 such that tightness of the barrel nut 108 with respect to the first wedge member 102 and the second wedge member 104 may be limited. In other embodiments, the divider 150 may be integral to the handguard 112. In still other embodiments, the divider 150 may be integral to the adjustable barrel nut locking mechanism 110.

By way of example, when the first wedge member 102 includes a tapped wedge 102A and the second wedge member 104 includes a bore nut 104A, the second inward end 170 may rest against the divider 150. The first inward end 180 may face the divider 150 and, thus, the maximum tightness of the barrel nut 108 with respect to the adjustable barrel nut locking mechanism 110 may be determined, in part, by the size of the barrel nut 108 and/or the location of the divider 150. In various embodiments, the divider 150 may make up or be flush with aspects of the channel 114. The divider 150 may be integrally formed with the handguard 112 or, alternatively, may be a component of the adjustable barrel nut locking mechanism 110. For example, in accordance with the embodiments previously described wherein the biasing member 106 includes a screw 106A, the divider 150 may be located around the screw 106A between the tapped wedge 102A and the bore nut 104A and further located within the pathway 290.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A handguard system of a firearm, the handguard system comprising:

a barrel nut configured to secure a barrel to the firearm, the barrel nut comprising a radial profile that forms first, second and third recessed rings at spaced apart longitudinal positions of the barrel nut with respect to a proximate end of the handguard, wherein the first, second and third recessed rings each comprises respective sloping portions, the respective sloping portions comprising a longitudinal section of the barrel nut having a progressively decreasing diameter;

a handguard comprising first, second and third pathways, the pathways being transversely disposed relative to the handguard and offset longitudinally along the handguard; and a first adjustable barrel nut locking mechanism disposed in the first pathway, a second adjustable barrel nut locking mechanism disposed in the second pathway, and a third adjustable barrel nut locking mechanism disposed in the third pathway, wherein:

the first adjustable barrel nut locking mechanism comprising:

a first wedge member, wherein the first wedge member has an asymmetrical outer profile that comprises a first flat wedge surface, a first curved wedge surface, and a first planar wedge adjustment surface at a first angle relative to the longitudinal axis of the first wedge member;

a second wedge member; and a first biasing member configured to:

couple the first wedge member to the second wedge member; and incrementally bias the first wedge member toward the second wedge member, which second wedge member is in a fixed position, upon actuation of the first biasing member, such that the first wedge member and the second wedge member tighten about the barrel nut at the first recessed ring, wherein first biasing member is positioned transversed to the longitudinal axis of the barrel nut, urging the first wedge member in a first direction; and the second adjustable barrel nut locking mechanism comprises:

a third wedge member, wherein the third wedge member has an asymmetrical outer profile that comprises a second flat wedge surface, a second curved wedge surface, and a second planar wedge adjustment surface at the first angle relative to the longitudinal axis of the third wedge member;

a fourth wedge member; and a second biasing member configured to:

couple the third wedge member to the fourth wedge member; and incrementally bias the third wedge member toward the fourth wedge member, which fourth wedge member is in a fixed position, upon actuation of the second biasing member, such that the third wedge member and the fourth wedge member tighten about the barrel nut at the second recessed ring, wherein the second biasing member is positioned transverse to the longitudinal axis of the barrel nut, urging the third wedge member in a second direction, opposite the first direction; and the third adjustable barrel nut locking mechanism comprises:

a fifth wedge member, wherein the fifth wedge member has an asymmetrical outer profile that comprises a third flat wedge surface, a third curved wedge surface, and a third planar wedge adjustment surface at the first angle relative to the longitudinal axis of the fifth wedge member;

a sixth wedge member; and a third biasing member configured to:

couple the fifth wedge member to the sixth wedge member; and incrementally bias the fifth wedge member toward the sixth wedge member, which is in a fixed position, upon actuation of the third biasing member, such that the fifth wedge member and the sixth wedge member tighten about the barrel nut at the third at the third recessed ring, wherein the third biasing member is positioned transverse to the longitudinal axis of the barrel nut, urging the fifth wedge member in the first direction.

2. The handguard system of claim 1, wherein, within the longitudinal section of sloping portion of each of the first, second and third recessed rings, the diameter transitions from a greater diameter at a position further from the upper receiver to a lesser diameter at a position closer to the upper receiver.

3. The handguard system of claim 2, wherein:

the handguard further comprises a longitudinally disposed channel that geometrically corresponds to the barrel nut; and the pathway is configured to intersect with the channel at a direction substantially normal to a longitudinal axis of the channel.

4. The handguard system of claim 3, wherein the first wedge member and the second wedge member of the adjustable barrel nut locking mechanism are configured to tighten about the barrel nut in communication with the channel upon actuation of the biasing member.

5. The handguard system of claim 4, wherein the pathway comprises a first section joined to a second section by a middle section, the first section configured to receive the first wedge member, the second section configured to receive the second wedge member, and the biasing member configured to pass through the middle section.

6. The handguard system of claim 5, wherein the first wedge member comprises an asymmetrical outer profile with respect to a longitudinal axis of the first wedge member and the first section of the pathway comprises a corresponding cutout profile with respect to a longitudinal axis of the pathway such that the first wedge member can only be received by the first section of the pathway at a preferred orientation with respect to the longitudinal axis of the pathway and further with respect to a longitudinal axis of the handguard.

7. The handguard system of claim 6, wherein the asymmetrical outer profile of the first wedge member comprises at least one flat wedge surface and at least one curved wedge surface.

8. The handguard system of claim 1, further comprising a divider disposed about the pathway, the divider configured to restrict travel of the first wedge member about the pathway and with respect to the second wedge member such that tightness of the barrel nut with respect to the first wedge member and the second wedge member is limited.

9. The handguard system of claim 8, wherein the divider is integral to the handguard.

10. The handguard system of claim 8, wherein the divider is integral to the adjustable barrel nut locking mechanism.

11. The handguard system of claim 1, wherein:

the first wedge member comprises a tapped wedge;

the second wedge member comprises a bore nut; and the biasing member comprises a screw, the tapped wedge comprising a tapped hole corresponding to a thread pattern of the screw such that the tapped wedge can be biased toward the bore nut by tightening the screw when the screw is engaged within the tapped hole of the tapped wedge.

12. The handguard system of claim 11, wherein:

the first section of the pathway comprises a tapped wedge cutout corresponding to the geometry of the tapped wedge;

the second section of the pathway comprises a bore nut cutout corresponding to the geometry of the bore nut; and the middle section of the pathway comprises a hollow diameter providing for travel of the screw within the middle section.

13. The handguard system of claim 11, wherein:

the tapped wedge and the bore nut are configured to engage the barrel nut at a direction substantially normal to the barrel nut; and the bore nut comprises a recess configured to receive a head of the screw from a position external to the handguard.

14. A handguard system of a firearm, the handguard system comprising:

a handguard comprising first and second pathways, the pathways being transversely disposed relative to the handguard and offset longitudinally along the handguard;

a handguard comprising a transversely disposed pathway;

a barrel nut configured to secure a barrel to the firearm, the barrel nut comprising a radial profile that forms first, second and third recessed rings at spaced apart longitudinal positions of the barrel nut with respect to a proximate end of the handguard, wherein the first second and third recessed rings each comprises respective sloping portions, the respective sloping portions comprises a longitudinal section of the barrel nut having a progressively decreasing diameter; and a first adjustable barrel nut locking mechanism disposed in the first pathway, a second adjustable barrel nut locking mechanism disposed in the second pathway, and a third adjustable barrel nut locking mechanism disposed in the third pathway, wherein:

the first adjustable barrel nut locking mechanism comprises:

a first wedge member, wherein the first wedge member has an asymmetrical outer profile that comprises a first flat wedge surface, a first curved wedge surface, and a first planar wedge adjustment surface at a first angle relative to the longitudinal axis of the first wedge member;

a second wedge member; and a first biasing member configured to:

couple the first wedge member to the second wedge member;

incrementally bias the first wedge member toward the second wedge member upon actuation of the first biasing member, such that the first wedge member and the second wedge member tighten about the barrel nut at the first recessed ring, wherein first biasing member is positioned transversed to the longitudinal axis of the barrel nut, urging the first wedge member in a first direction;

the second adjustable barrel nut locking mechanism comprises:

a third wedge member, wherein the third wedge member has an asymmetrical outer profile that comprises a second flat wedge surface, a second curved wedge surface, and a second planar wedge adjustment surface at the first angle relative to the longitudinal axis of the third wedge member;

a fourth wedge member; and a second biasing member configured to:

couple the third wedge member to the fourth wedge member;

incrementally bias the third wedge member toward the fourth wedge member upon actuation of the second biasing member, such that the third wedge member and the fourth wedge member tighten about the barrel nut at the second recessed ring, wherein the second biasing member is positioned transverse to the longitudinal axis of the barrel nut, urging the third wedge member in a second direction, opposite the first direction; and the third adjustable barrel nut locking mechanism comprises:

a fifth wedge member, wherein the fifth wedge member has an asymmetrical outer profile that comprises a third flat wedge surface, a third curved wedge surface, and a third planar wedge adjustment surface at the first angle relative to the longitudinal axis of the fifth wedge member;

a sixth wedge member; and a third biasing member configured to:

couple the fifth wedge member to the sixth wedge member; and incrementally bias the fifth wedge member toward the sixth wedge member, which is in a fixed position, upon actuation of the third biasing member, such that the fifth wedge member and the sixth wedge member tighten about the barrel nut at the third at the third recessed ring, wherein the third biasing member is positioned transverse to the longitudinal axis of the barrel nut, urging the fifth wedge member in the first direction.

15. The handguard system of claim 14, wherein:

the first wedge member comprises a first tapped wedge;

the second wedge member comprises a first bore nut;

the first biasing member comprises a first screw, the first tapped wedge comprising a tapped hole corresponding to a thread pattern of the first screw such that the first tapped wedge can be biased toward the first bore nut by tightening the first screw when engaged within the tapped hole of the first tapped wedge;

the third wedge member comprises a second tapped wedge;

the fourth wedge member comprises a second bore nut; and the second biasing member comprises a second screw, the second tapped wedge comprising a tapped hole corresponding to a thread pattern of the second screw such that the second tapped wedge can be biased toward the second bore nut by tightening the second screw when engaged within the tapped hole of the second tapped wedge.

16. The handguard system of claim 14, wherein:

the handguard further comprises a longitudinally disposed channel, the channel configured to geometrically correspond to the barrel nut; and the first and second pathways are each configured to intersect with the channel at a direction substantially normal to a longitudinal axis of the channel.

17. The handguard system of claim 16, wherein:

the first wedge member and the second wedge member of the first adjustable barrel nut locking mechanism are configured to tighten about the barrel nut in communication with the channel upon actuation of the first biasing member; and the third wedge member and the fourth wedge member of the second adjustable barrel nut locking mechanism are configured to tighten about the barrel nut in communication with the channel upon actuation of the second biasing member.

* * * * *